US007451979B2

(12) United States Patent
Masotta et al.

(10) Patent No.: US 7,451,979 B2
(45) Date of Patent: Nov. 18, 2008

(54) HIGH THROUGHPUT SHEET ACCUMULATOR

(75) Inventors: John R. Masotta, Bethel, CT (US); William J. Wright, Killingworth, CT (US); Robert E. Manna, Newtown, CT (US); Charles C Fuller, Shelton, CT (US); John W. Sussmeier, New York, NY (US)

(73) Assignee: Pitney Bowes Inc., Stamford, CT (US)

( * ) Notice: Subject to any disclaimer, the term of this patent is extended or adjusted under 35 U.S.C. 154(b) by 239 days.

(21) Appl. No.: 11/525,439

(22) Filed: Sep. 22, 2006

(65) Prior Publication Data

US 2007/0013119 A1 Jan. 18, 2007

Related U.S. Application Data

(63) Continuation of application No. 10/938,666, filed on Sep. 10, 2004, now Pat. No. 7,121,544.

(51) Int. Cl.
*B65H 31/00* (2006.01)

(52) U.S. Cl. ..... 271/209; 271/182; 271/184; 271/3.19; 271/233; 271/243; 271/245; 414/790.7

(58) Field of Classification Search ..... 271/209, 271/182, 184, 3.19, 233, 243, 245; 414/790.7; 198/812

See application file for complete search history.

(56) References Cited

U.S. PATENT DOCUMENTS 3,206,191 A * 9/1965 Hantscho ..... 493/405
3,294,081 A * 12/1966 Zach ..... 126/113
3,542,382 A * 11/1970 Hagmann ..... 277/649
3,815,897 A * 6/1974 Hoehl et al. ..... 271/9.13
3,908,527 A * 9/1975 Brockmuller et al. .... 414/789.1
4,046,259 A * 9/1977 Dunlap ..... 209/566
4,078,790 A * 3/1978 Stocker ..... 271/213

(Continued)

FOREIGN PATENT DOCUMENTS

DE 4441453 A1 * 1/1996

(Continued)

*Primary Examiner*—Douglas A Hess
(74) *Attorney, Agent, or Firm*—Christopher H. Kirkman; Steven J. Shapiro; Angelo N. Chaclas

(57) ABSTRACT

An improved sheet accumulator for stacking serially fed sheets transported on a paper path. The accumulator includes a guide deck. Above the guide deck, a plurality of parallel belts are positioned to provide a driving force for sheets on the deck. Within the accumulator, a ramp apparatus is positioned across the paper path whereby sheets driven by the belts on an upstream portion of the accumulator deck are driven over the ramp apparatus and deposited in an accumulating region of the accumulator deck on a downstream side of the ramp apparatus. Preferably, snap-down belts are provided between ramp structures snap transported sheets quickly into place on the stack and to hold them there. Sheets are stopped by an accumulator stop mechanism located at a downstream end of the accumulating region that prevents movement of sheets by the belts while sheets for an accumulation are being collected. When an accumulation is completed, the accumulator stop mechanism allows sheets to be transported from the accumulating region. Preferably the guide deck and ramp are adjustable for different sized sheets.

25 Claims, 10 Drawing Sheets

U.S. PATENT DOCUMENTS 4,223,882 A * 9/1980 Stocker ..... 493/11
4,431,322 A * 2/1984 Nally et al. ..... 400/605
4,518,161 A * 5/1985 Nakamura ..... 271/303
4,602,776 A * 7/1986 York et al. ..... 271/4.01
4,640,506 A * 2/1987 Luperti et al. ..... 271/212
4,729,282 A * 3/1988 Kasdorf ..... 83/26
4,732,261 A * 3/1988 Mattern et al. ..... 198/431
4,799,633 A * 1/1989 Lahti et al. ..... 244/130
4,805,891 A * 2/1989 Luperti et al. ..... 271/212
4,925,180 A * 5/1990 Golicz ..... 271/198
5,083,769 A * 1/1992 Young, Jr. ..... 271/280
5,147,092 A * 9/1992 Driscoll et al. ..... 271/184
5,178,379 A * 1/1993 Edwards et al. ..... 271/189
5,244,200 A * 9/1993 Manzke ..... 271/198
5,342,038 A * 8/1994 Suter ..... 271/198
5,364,085 A * 11/1994 Kennish ..... 270/58.02
5,375,825 A * 12/1994 Kennish ..... 270/58.02
5,484,255 A * 1/1996 Lowell ..... 414/789
5,590,873 A * 1/1997 Smart et al. ..... 271/303
5,775,689 A * 7/1998 Moser et al. ..... 271/198
5,776,409 A * 7/1998 Almquist et al. ..... 264/401
6,203,006 B1 * 3/2001 Semanick et al. ..... 271/213
6,386,537 B1 * 5/2002 Howard et al. ..... 271/303
6,644,651 B2 * 11/2003 Allsup ..... 271/184
6,644,657 B2 * 11/2003 Wright et al. ..... 271/242
6,902,162 B2 * 6/2005 Otto et al. ..... 271/207
6,978,995 B2 * 12/2005 Middelberg et al. ..... 271/198
7,121,544 B2 * 10/2006 Masotta et al. ..... 271/209
7,207,493 B2 * 4/2007 Dunn et al. ..... 235/475

FOREIGN PATENT DOCUMENTS

GB 1445913 A1 * 8/1976

* cited by examiner

HIGH THROUGHPUT SHEET ACCUMULATOR

This is a continuation of U.S. application Ser. No. 10/938,666, now issued as U.S. Pat. No. 7,121,544, filed Sep. 10, 2004.

TECHNICAL FIELD

The present invention relates to an accumulator for collating serially fed sheets into stacks.

BACKGROUND OF THE INVENTION

Inserter systems, such as those applicable for use with the present invention, are typically used by organizations such as banks, insurance companies and utility companies for producing a large volume of specific mailings where the contents of each mail item are directed to a particular addressee. Also, other organizations, such as direct mailers, use inserts for producing a large volume of generic mailings where the contents of each mail item are substantially identical for each addressee. Examples of such inserter systems are the 8 series, 9 series, and APS™ inserter systems available from Pitney Bowes Inc. of Stamford Conn.

In many respects, the typical inserter system resembles a manufacturing assembly line. Sheets and other raw materials (other sheets, enclosures, and envelopes) enter the inserter system as inputs. Then, a variety of modules or workstations in the inserter system work cooperatively to process the sheets until a finished mail piece is produced. The exact configuration of each inserter system depends upon the needs of each particular customer or installation.

Typically, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

The input stages of a typical inserter system are depicted in FIG. 1. At the input end of the inserter system, rolls or stacks of continuous printed documents, called a "web," are fed into the inserter system by a web feeder 10. The continuous web must be separated into individual document pages. This separation is typically carried out by a web cutter 20 that cuts the continuous web into individual document pages. Depending on the mail run specifications, the cutter 20 can be set to cut sheets of different sizes. For example, some mailings may require letter size sheets, while others might include legal sized pages, or smaller than letter sized pages. Downstream of the web cutter 200, a right angle turn 300 may be used to reorient the documents, and/or to meet the inserter user's floor space requirements.

The cut pages must subsequently be accumulated into collations corresponding to the multi-page documents to be included in individual mail pieces. This gathering of related document pages occurs in the accumulator module 400 where individual pages are stacked on top of one another.

The control system for the inserter senses markings on the individual pages to determine what pages are to be collated together in the accumulator module 400. In a typical inserter application, mail pieces may include varying number of pages to be accumulated. When a document accumulation is complete, then the accumulation is discharged as a unit from the accumulator 400. An accumulator module 400 should also be adjustable so that it is capable of handling sheet accumulations of different sizes.

A conventional accumulator module 400 is described in U.S. Pat. No. 5,083,769 to Young, which is hereby incorporated by reference in its entirety. While this conventional accumulator has been found to operate successfully in transporting paper sheets at up to 150 inches per second (ips), it has been found to become unstable at higher speeds, such as 300 ips. Also, the conventional accumulator has been successful at accumulating sets of documents having on the order of eight sheets. However for improved processing capabilities it has become desirable to collate as many as twenty sheets.

Downstream of the accumulator 400, a folder 500 typically folds the accumulation of documents to fit in the desired envelopes. To allow the same inserter system to be used with different sized mailings, the folder 500 can typically be adjusted to make different sized folds on different sized paper. As a result, an inserter system must be capable of handling different lengths of accumulated and folded documents.

Downstream of the folder 500, a buffer transport 600 transports and stores accumulated and folded documents in series in preparation for transferring the documents to the synchronous inserter chassis 700. By lining up a backlog of documents in the buffer 600, the asynchronous nature of the upstream accumulator 400 will have less impact on the synchronous inserter chassis 700. On the inserter chassis 700 inserts are added to the folded accumulation prior to insertion into an envelope at a later module.

SUMMARY OF THE INVENTION

While the prior art accumulator described above often performs satisfactorily at speeds in the range of 150 ips, it has been found that at higher speeds, such as 300 ips, paper sheets will flutter and be damaged. The improved accumulator also allows high speed stacking of a greater number of sheets. Using a prior art accumulator, stacks of up to eight sheets could be created, where the preferred embodiment of the present invention can reliably handle stacks of up to twenty sheets.

The improved sheet accumulator, typically for use in an inserter system, includes, stacks serially fed sheets transported on a paper path. The accumulator includes a stationary accumulator guide deck having a smooth upper surface and forming a lower portion of the paper path. Above the guide deck, a plurality of parallel belts are positioned to provide a driving force for sheets on the deck. To assist in transporting the sheets, the lower runs of the plurality of belts may be downwardly biased against the stationary deck.

Within the accumulator, a ramp apparatus is positioned across the paper path whereby sheets driven by the belts on an upstream portion of the accumulator deck are driven over the ramp apparatus and deposited in an accumulating region of the accumulator deck on a downstream side of the ramp apparatus. Sheets are stopped and stacked by an accumulator stop mechanism located at a downstream end of the accumulating region that prevents movement of sheets by the belts while sheets for an accumulation are being collected. When an accumulation is completed, the accumulator stop mechanism allows sheets to be transported from the accumulating region.

To adjust for different sized sheets, in a preferred embodiment, the guide deck and ramp are adjustable to accommodate different sized sheet stacks. The adjustable paper path guide deck apparatus includes a first roller proximal the input end and a second roller proximal to the output end. These rollers support a flexible sheet of non-permanently deforming material wrapped around them. The surface of the sheet forms a guide deck for the paper path.

The adjustable guide deck is movable back and forth along a paper path direction while moving around the first and second rollers. A locking mechanism is coupled to the adjustable paper path guide deck apparatus for preventing the flexible sheet from moving around the first and second rollers when in a locked position, and allowing movement around the first and second rollers when in an unlocked position.

In the preferred embodiment, the accumulator ramp is coupled to the flexible sheet and operates on sheets transported in the paper path. A position of the ramp between the input end and the output end of the paper path is adjustable by moving the flexible sheet around the first and second rollers.

In a further preferred embodiment, the accumulator may be comprised of dual paper paths. In the dual arrangement, an input transport for receives serially fed sheets from an upstream module. Sheets are diverted to either a top accumulator or a bottom accumulator, each accumulator operating substantially as described above. The dual accumulator arrangement allows for stacking to continue in a second accumulator, while a completed collation is being removed from a first accumulator. Thus the dual accumulators typically alternate in handling accumulations, and allow for uninterrupted processing.

Downstream of the dual accumulators, a merging transport receives completed accumulations from both accumulators and merges them back into a single output transport path.

Further details of the present invention are provided in the accompanying drawings, detailed description and claims.

DETAILED DESCRIPTION

Figure 1:
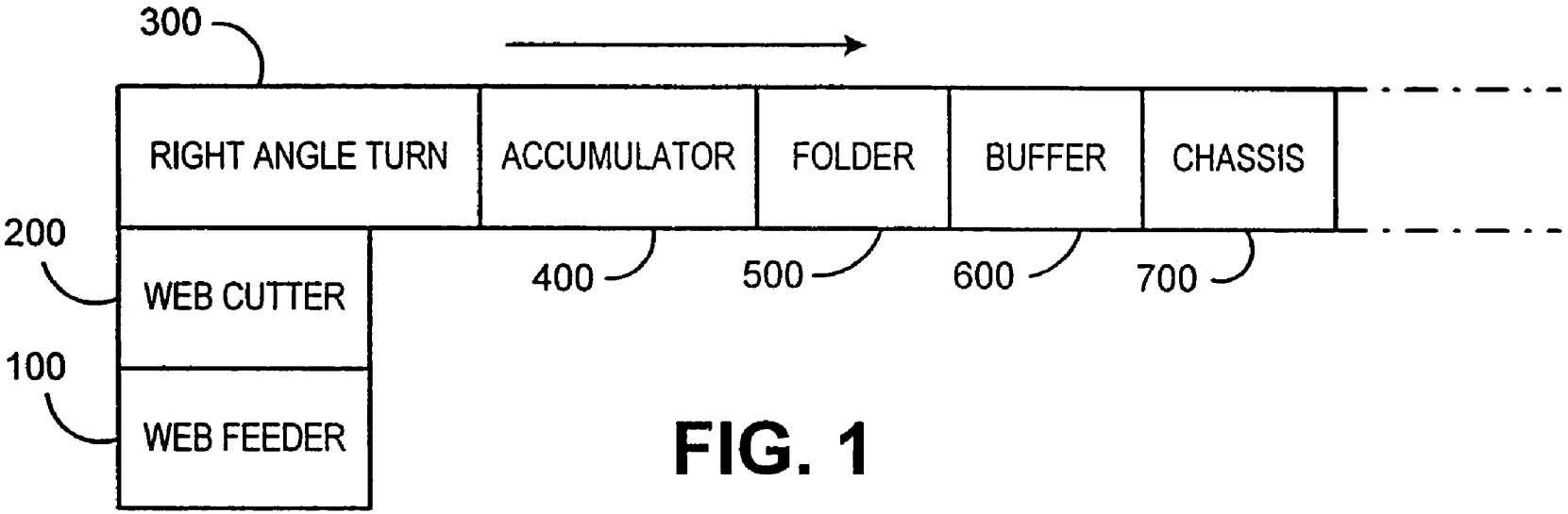
FIG. 1 is a diagram of the input stages of an inserter system for use with the present invention.
Figure 2:
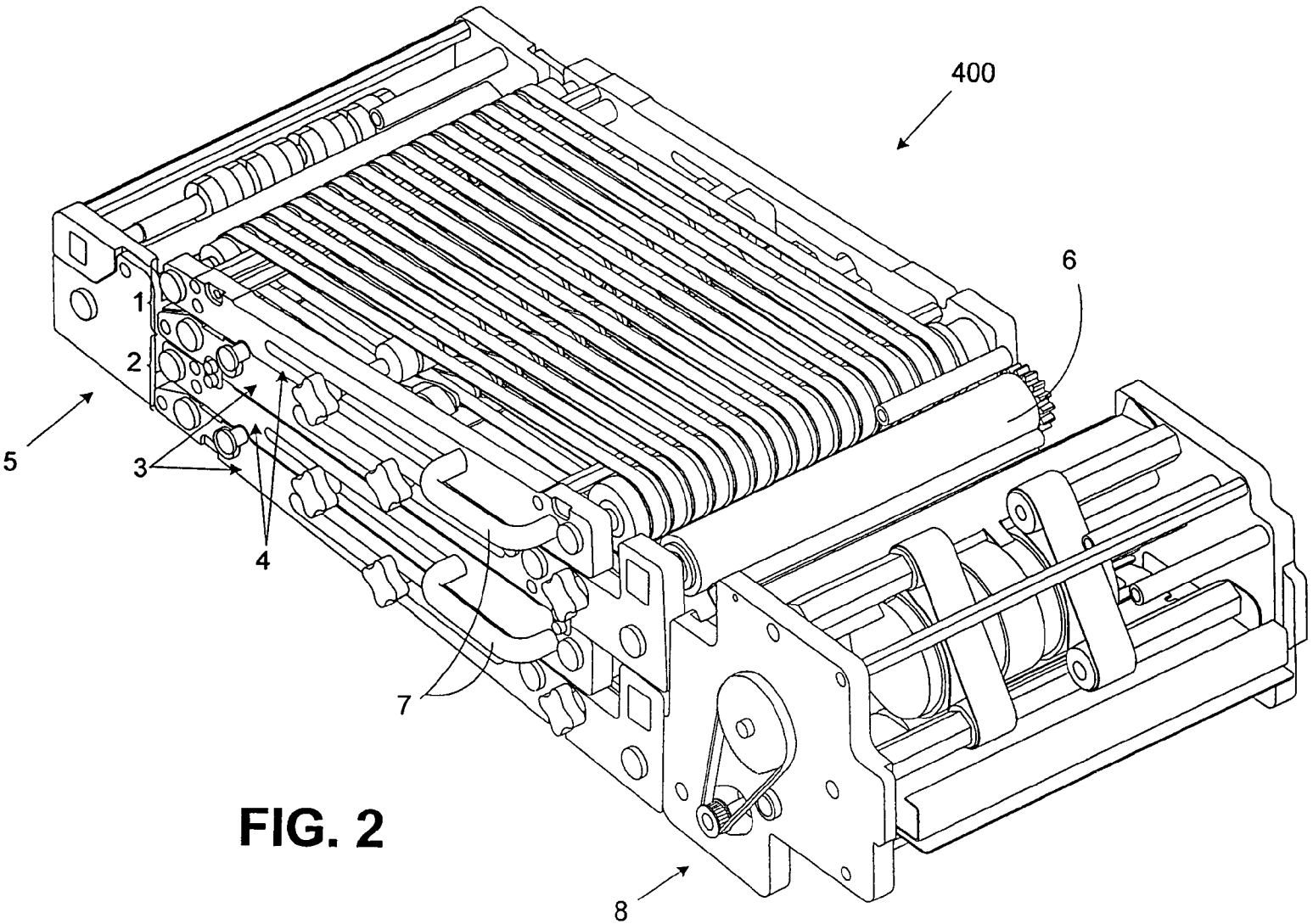
FIG. 2 depicts an isometric view of an improved dual accumulator.
Figure 6:
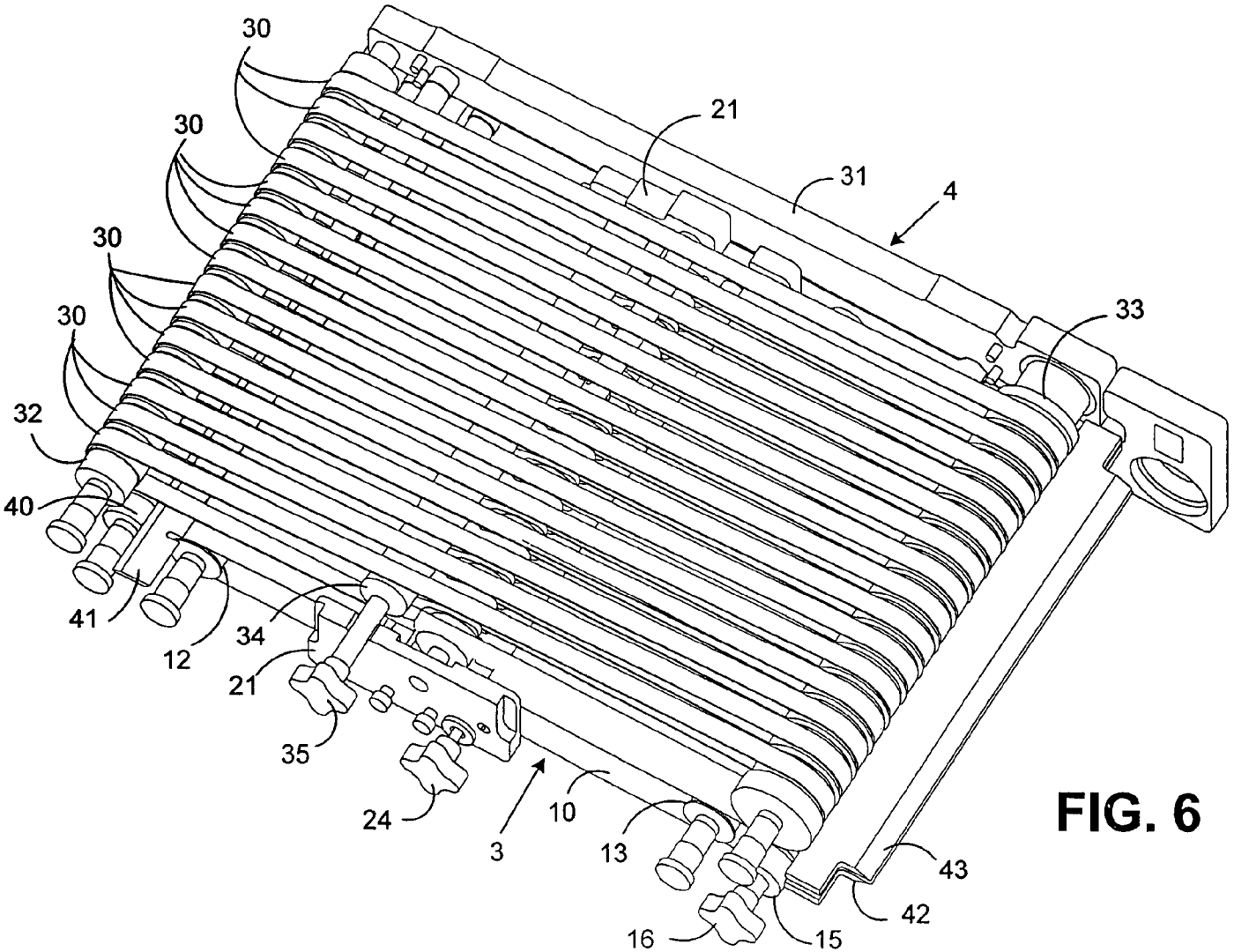
FIG. 6 depicts an isometric view of an accumulator with its upper assembly in place.

FIG. 2 provides an overview of the major components included in a preferred embodiment of a dual accumulator 400 in accordance with the present invention. The dual accumulator 400 includes an upper accumulator 1 and a lower accumulator 2. Each of the upper and lower accumulators 1, 2 include a lower assembly 3 and an upper assembly 4. Preferably the upper assembly 4, including the array of belts 30 (FIG. 6), can be lifted from the lower assembly 3 (FIG. 4), by manual lifting of handle 7. A divert mechanism 8 is located at the downstream-most end of the dual accumulator 400 to remove any misprocessed collations before transporting them to the next downstream module (typically a folder 500).

Sheets are provided to an upstream end of the accumulator 400 by input module 5. As seen in the cut away side view of FIG. 3, input module 5 begins with a high-speed nip section 41, which can either match velocity with an upstream module, or accelerate sheets to a higher velocity. The need to accelerate sheets would be to increase the gaps between them or physically create a gap from an overlap or underlap.

Following the high-speed nip 41 is a standard flipper gate 42, which is used to select between the upper accumulator 1 and lower accumulator 2. Guide brackets 43 guide sheets between the flipper 42 and the individual accumulators 1 or 2.

The entrance to each accumulator 1 or 2 consists of a belted nip between rollers 32 and 40, with evenly spaced flat belts 30 overhead, driving idler roller 40 underneath. The belt 30 speed is matched to the high speed nip 41 (or slightly faster to create a "tug") to ensure good registration of the sheets. The overhead belts 30 are driven from a common motor (not shown) and drive roller 33, to ensure that each belt 30 maintains the same speed throughout the transport. The relatively wide belts 30 (as compared to prior art o-ring arrangement described in U.S. Pat. No. 5,083,769) combined with the high number of them help maintain the sheets orientation throughout the transport. As a result, sideguides are not needed to correct for skew errors.

Following the entrance nip between rollers 32 and 40 is a flat transport section. Here, all the belts 30 participate in driving the paper while at the same time holding it flat against the flexible deck 10.

Figure 3:
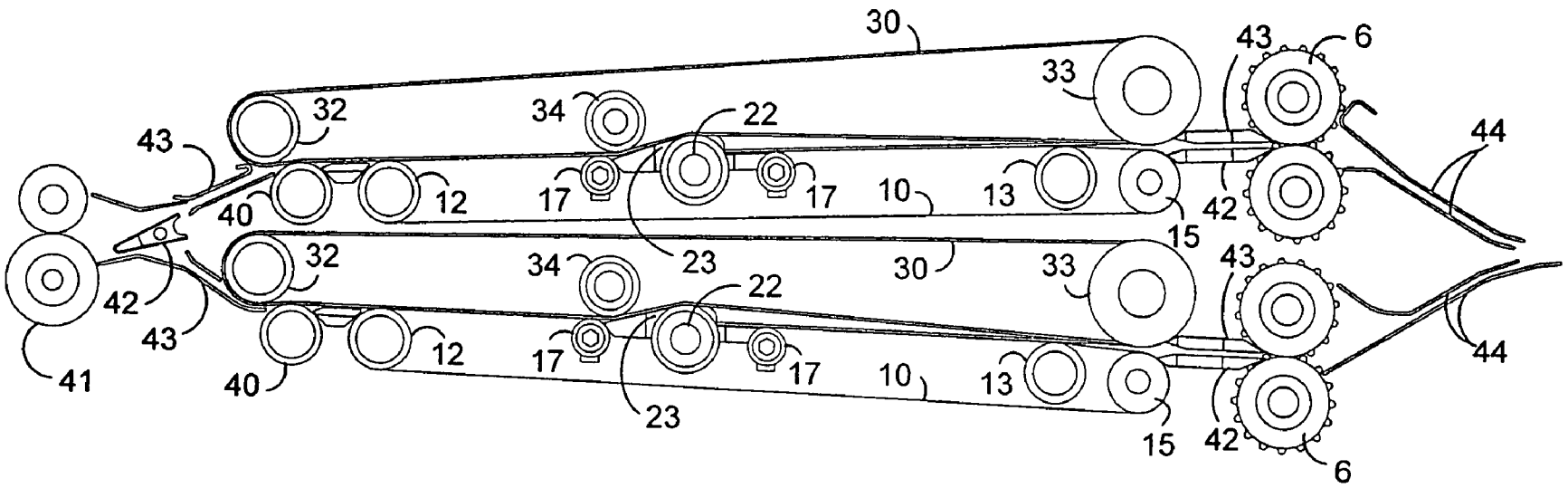
FIG. 3 depicts a cut-away side view of the improved dual accumulator.
Figure 4:
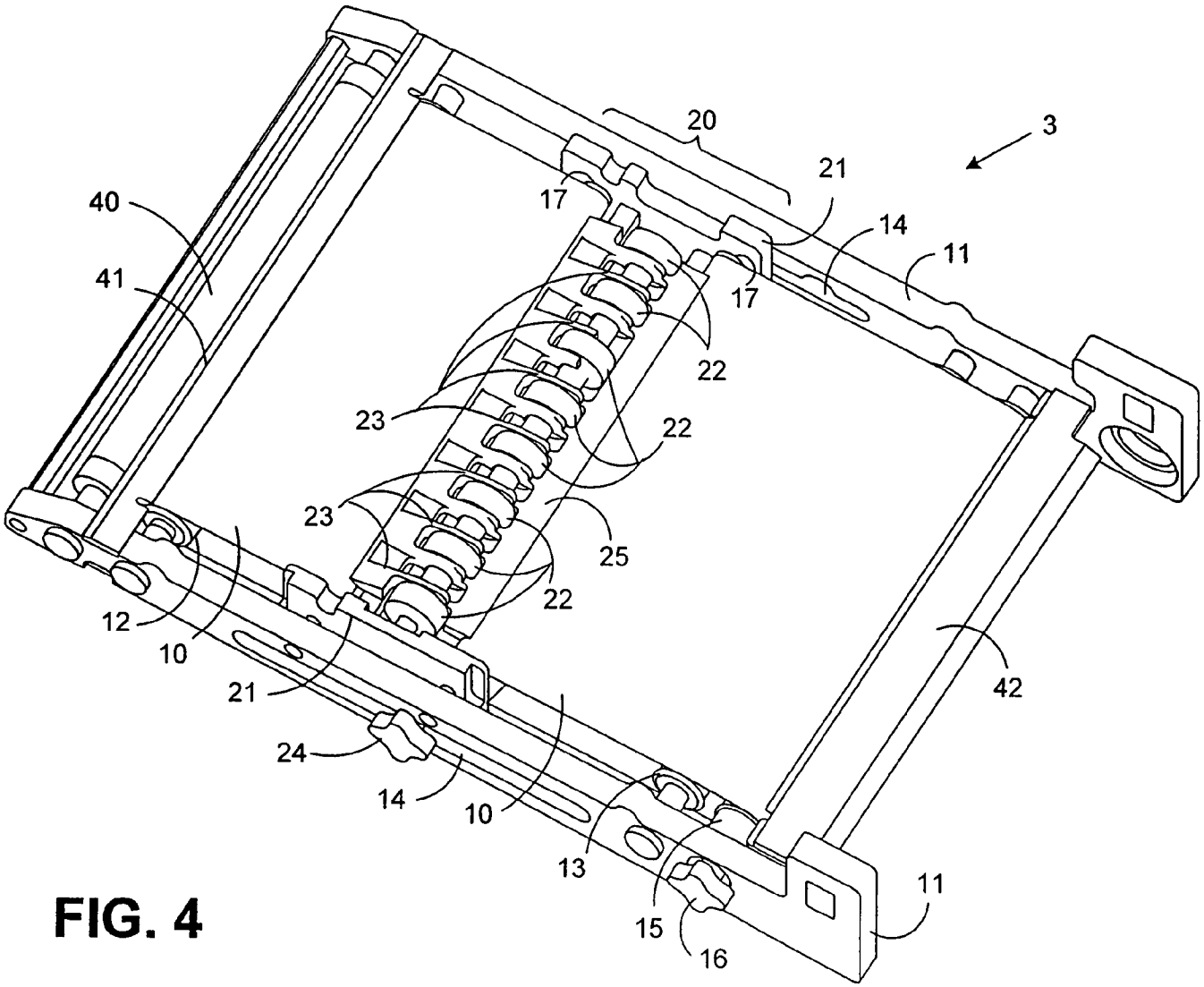
FIG. 4 depicts an isometric view of a lower assembly of an accumulator utilizing the present invention.
Figure 9:
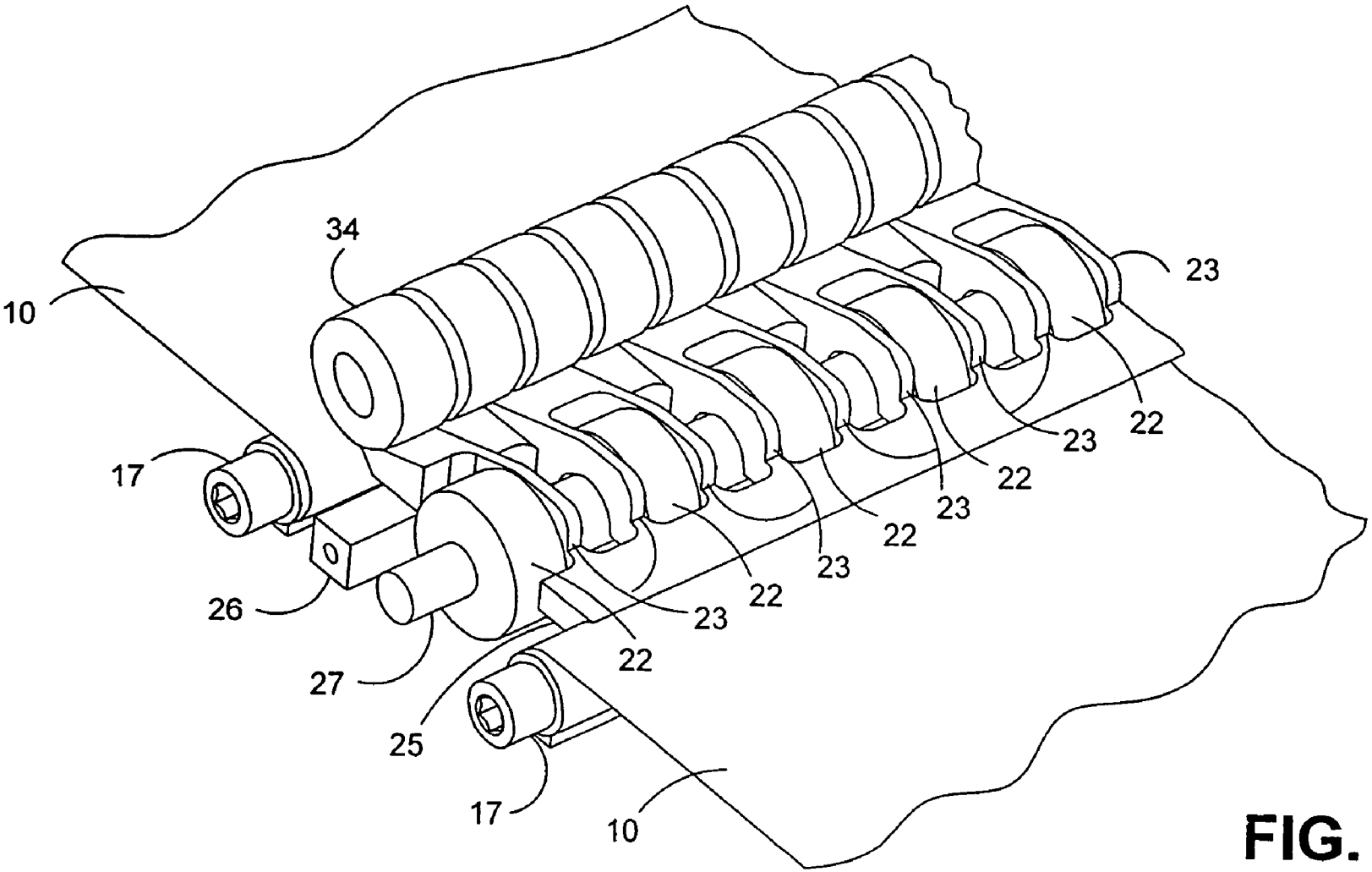
FIG. 9 is a close-up view of a ramp assembly for the accumulator.

Following the upstream transport section of deck 10 is the ramp section 20, as seen in FIG. 4, and a closer view in FIG. 9. The ramp structures 23 are angled to lift each sheet approximately 10 mm above the sheets already residing in the collation area on deck 10 downstream of ramp assembly 20. Just before the ramps 23, the overhead belts 30 are constrained from above by an idler roller 34, as seen in FIGS. 3, 7, 9, 10, and 11. This roller 34 ensures that the belt portions above the upstream transport section are not affected by paper in the ramp section 20. It also creates a pivot point close enough to the ramps 23 for the belts 30 to provide a very quick "snap" of the trail edge. This arrangement of the deck 10, ramp 20, and belts 30 allow the accumulator to run very small gaps between sheets.

Figure 10A:
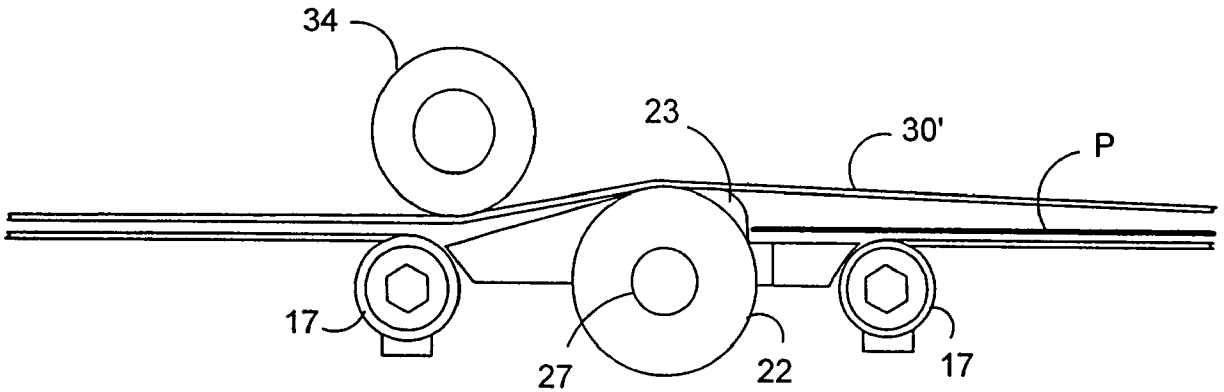
FIGS. 10*a* and 10*b* depict a side view of the ramp assembly with no sheets being transported over the ramp.
Figure 10B:
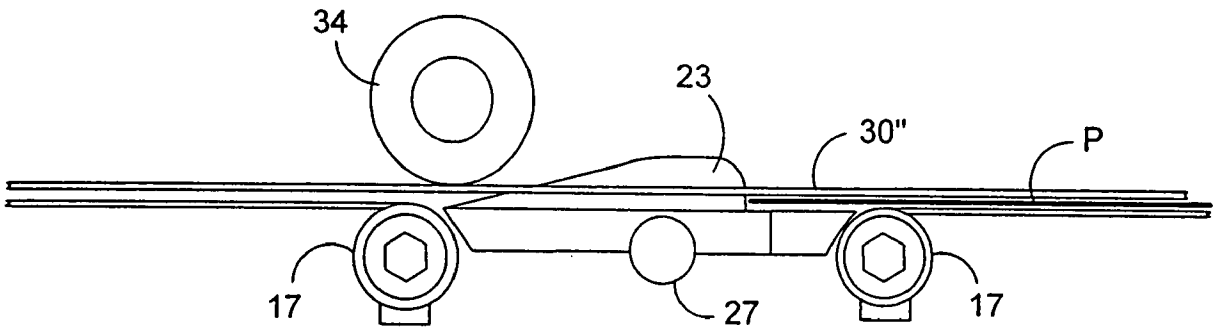
Figure 11A:
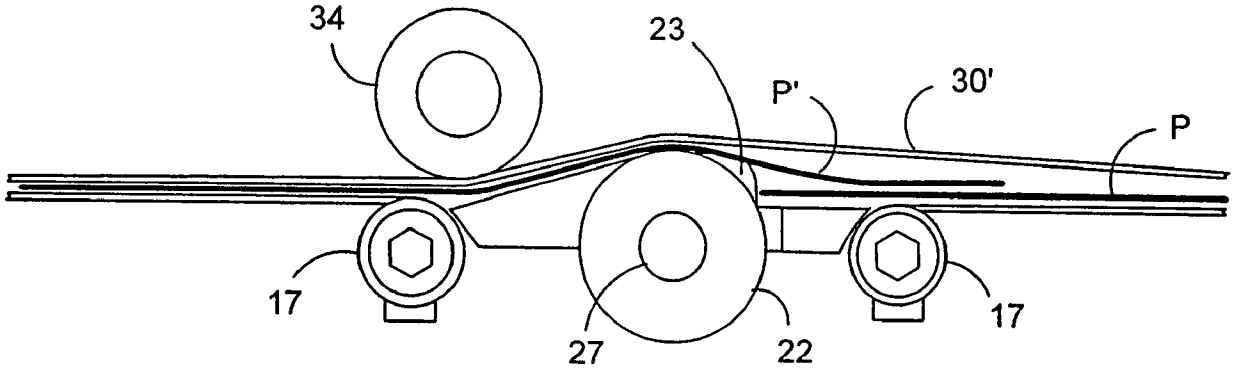
FIGS. 11*a* and 11*b* depict a side view of the ramp assembly while a sheet is being transported over the ramp.
Figure 11B:
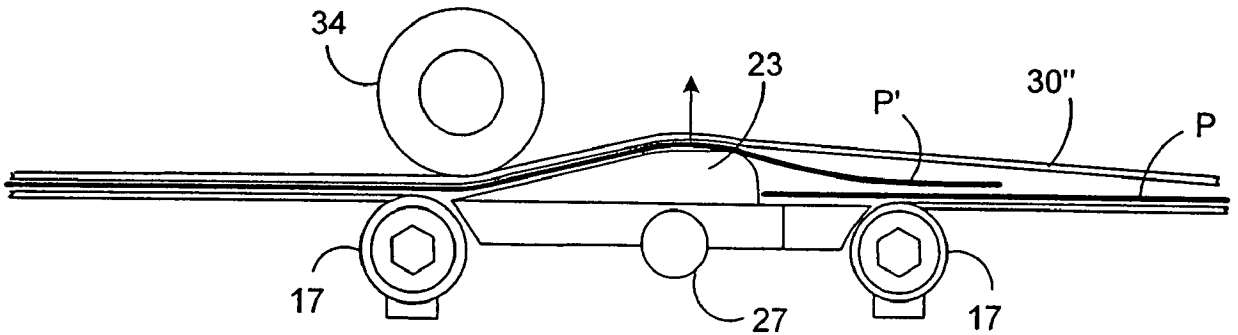

To assist in describing the interaction of the ramp apparatus 20 and the belts 30, close-up side view FIGS. 10*a*, 10*b*, 11*a*, and 11*b* are provided. In FIGS. 10*a* and 10*b*, operation is depicted while no sheet is being transported over the ramp apparatus 20 comprised of ramp structures 23 and rollers 22. Idler rollers 22 are preferably supported on a common shaft 27. In FIGS. 11*a* and 11*b*, a sheet P' is being transported over the ramp apparatus 20.

As seen in these figures, downstream of idler roller 34, the belts 30 interact with the ramp apparatus 20 split in two distinct ways. In the preferred embodiment, every other belt 30 remains a drive means, which passes up each ramp structure 23 to another idler roller 22 at the apex of each ramp. For this description, the drive means belts are referred to as 30', as seen in FIGS. 10*a* and 11*a*. This first group of belts 30' and idler rollers 22 ensure positive drive on each sheet until it reaches the dump roller 6 at the far downstream end of the accumulator 1 or 2.

The other half of the belts 30, between the drive belts 30', becomes a "snap" belt 30". For this description the snap belts will be referred to by the number 30", as seen in FIGS. 10*b* and 11*b*. These snap belts 30" fit in between the ramps 23 and idler rollers 22 and are nominally flat to the flexible deck 10 when no paper is present at the ramp 23, or flat against previously stacked sheets P in the accumulation area (see FIG. 10*b*). When a sheet enters the ramp section 20, the sheet P' physically lifts the snap belts 30" up over the ramps 23 with it. This action creates deformation of the snap belts 30" and additional tension along their length. When the trail edge of the sheet P' clears the ramps 23, this tension is released and the belt 30" quickly snaps the trail edge of the sheet against the deck (or previous sheet P) and holds it there.

As a sheet P' progresses over the ramps 23, it is driven by the drive belt 30' running over the idler roller 22 built into the ramps 23. These drive belts 30' then proceed to the main drive roller 33, which returns them to the entrance roller 32. In the preferred embodiment, the drive belts 30' act as paper guides once in the post-ramp accumulation area of deck 10 (they are nominally above the collation at all times). The snap belts 30" maintain intimate contact with the top sheet at all times and are responsible for damping any paper flutter and impact waves from contact with the dump roller 6. Snap belts 30" also provide any additional drive necessary to ensure the sheet reaches the dump roller 6 (FIGS. 2, 3).

The post-ramp accumulation area is a continuation of the flexible deck 10, with the flat belts 30 running overhead. At the flat belt drive roller 33, a transition is made between the drive roller 33 and flexible deck 10 to a pair of short, solid decks 42, 43 which are permanently spaced apart to accommodate the largest collation (preferably 20 sheets). These decks 42, 43 lead the sheets into the full-width dump rollers 6. The dump rollers 6 are preferably about two inches in diameter and are comprised of a relatively soft material that allows them to absorb the impact energy of each succesive sheet.

The bottom of the dump rollers 6 is preferably harder than the top, which create a solid floor on which to build the collation. The two rollers 6 are geared together to provide positive drive to the entire collation during the high acceleration portion of the dump motion profile, to prevent shingling of the collation. The snap belts 30" overhead provide an additional urge to ensure the collation exits as a coherent pack.

Following the dump section, the upper and lower paper paths 44 are once again merged into a single path. A divert mechanism 8 (FIG. 2) then allows collations to be selectively outsorted before the module 400 transports the paper to downstream modules (folder, inserter, etc.)

In the preferred embodiment, the transport deck 10 is adjustable to accommodate different sized sheets. The adjustable paper path guide deck is depicted in FIGS. 4-7. FIG. 4 depicts the paper path guide deck 10 used in a lower assembly 3 of an accumulator apparatus 1 or 2. Reference is made to co-pending application Ser. No. 10/938,814, titled Continuously Adjustable Paper Path Guide Deck, filed concurrently herewith, and incorporated by reference in its entirety.

As discussed above, and as depicted in FIG. 6, transported sheets are driven from above by belts 30, while on the flexible sheet 10. Deck sheet 10 has a low coefficient of friction to allow paper to slide over it while being driven by belts 30 from above.

Figure 5:
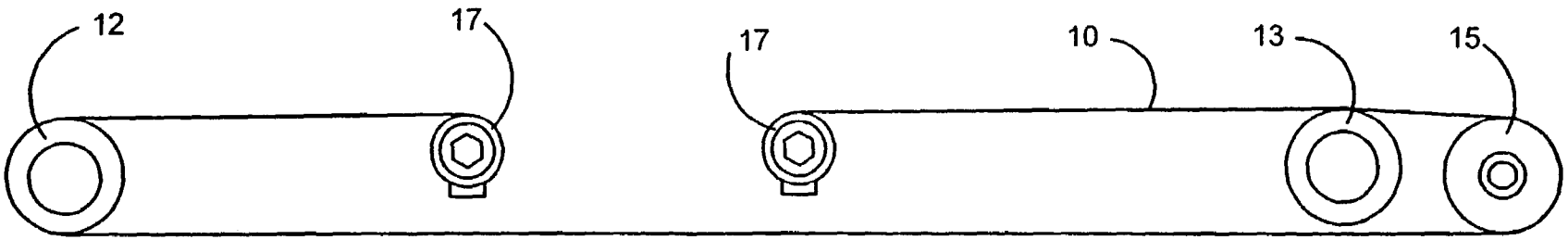
FIG. 5 depicts a side view of an adjustable paper path deck.

Preferably, as seen in FIG. 4 and the side view in FIG. 5, the flexible sheet 10 is a thin sheet non-permanently deforming material. The sheet 10 is wrapped around an upstream support roller 12 and a downstream support roller 15. In the preferred embodiment, the sheet 10 does not form a continuous loop and the ends of the sheet 10 are fixed around clamping bars 17 on an upper reach of the sheet wrapped around the rollers. The clamping bars 17 are coupled to a sheet-manipulating device, the position of which can be adjusted in an upstream or downstream direction by moving the sheet 10 around the rollers.

In an alternate embodiment, deck sheet 10 is comprised of a continuous belt loop wrapped around the rollers 12 and 15. In that embodiment, no clamping bars 17 are needed, and the ramp section 20 is coupled to the continuous sheet loop 10.

In the preferred embodiment the ramp apparatus 20 and the clamping bars 17 are mutually supported on moving side frames 21 on both lateral sides of the ramp 20. The moving side frames 21 are supported in slots 14 in lower side support members 11.

Figure 7:
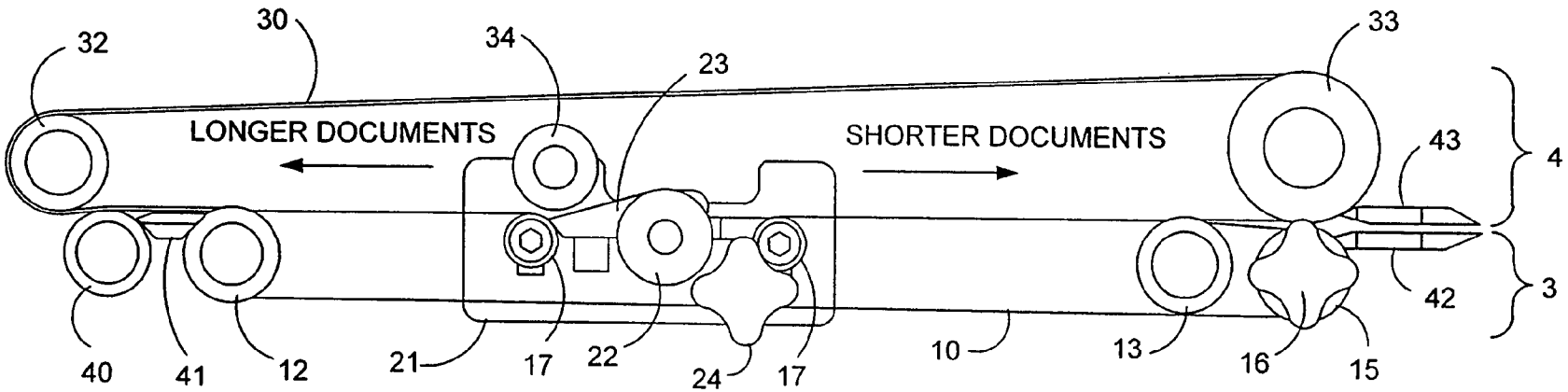
FIG. 7 depicts a side view of an accumulator using the adjustable paper path deck.

During normal operation sheet 10 remains stationary and does not move around the rollers 12 and 15. Likewise the ramp apparatus 20 and moving side frame 21 coupled between the ends of the sheet 10 remain stationary. However, for an accumulator to operate on different sized sheets, it may become necessary to adjust the positions of those components. In the preferred embodiment, the ramp apparatus 20 must be moved in an upstream direction in order to make more room for storing longer sheets in the accumulation region of sheet 10 downstream of the ramp apparatus 20 (FIG. 7). Conversely, for smaller sheets the ramp apparatus 20 would be moved in the downstream direction, while simultaneously shortening the region of sheet 10 that is downstream of the ramp apparatus 20. For the preferred application, the adjustable deck is adjustable to accommodate sheets from seven inches to fourteen inches long, resulting in at least a seven inch range of adjustability.

In the preferred embodiment a threaded locking knob 24 is tightened via a threaded rod member potion of side frame 21 to hold the side frame 21 in place during normal operation. The threaded rod member portion of side frame 21 is slidably supported in slots 14. To make an adjustment for different sized sheets, the locking knob 24 would be loosened, allowing the side frames 21 to move in the upstream and downstream directions along the slots 14. As the side frames 21 and ramp apparatus 20 were moved in the upstream and downstream directions, the deck sheet 10 moves around rollers 12 and 15, allowing more or less deck to be provided for supporting the sheets, as needed.

In the preferred embodiment, the adjustment of the flexible sheet 10 is achieved by rotating the roller 15 using adjustment knob 16 coupled thereto. Once adjustment knob 16 has been turned to adjust the accumulator ramp 20 and deck sheet 10 to their proper positions, locking knob 24 is tightened to hold the adjustable components in place. Preferably, rollers 12 and 15 incorporate ball-bearings, or other means to maintain smooth rolling action under load, to make adjustments easy.

In an alternative embodiment, rollers 12 and 15 may be turn-bars that do not rotate themselves, but that have sufficiently low friction that the sheet 10 can be bent and rotated around their surfaces when adjustments are being made. In any embodiment, a minimum radius of the rollers is determined by the choice of material for deck sheet 10, so that the deck sheet will not deform permanently.

The belt rollers 32 and 33 are preferably supported on upper side support members 31 positioned above lower side support members 11. At a downstream end of the accumulator apparatus, output guides 42 and 43 guide accumulations downstream of the adjustable portion of the accumulator.

As seen in FIGS. 4-7, a third deck roller 13 may be positioned between the primary deck rollers 12 and 15. The top of this third roller 13 is positioned to intersect and lift the top plane of the sheet 10 between the roller 12 and 15. This lifting provides a slope to the deck at a downstream end of the accumulator. This slope can serve to keep the belts 30" firmly pressed against the sheets on the upstream part of the slope, while opening some space for sheets, and reducing friction on sheets on the downstream portion of the slope proximal to dump rollers 6.

Figure 8:
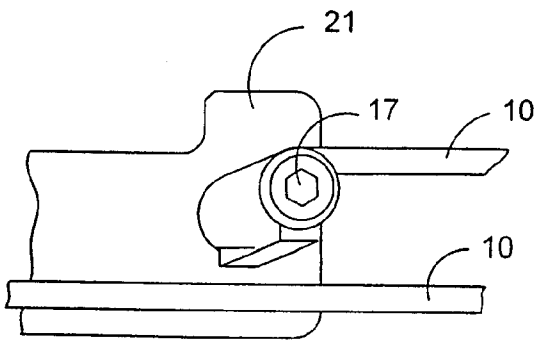
FIG. 8 depicts a tensioning mechanism for the adjustable paper path deck.

FIG. 8 depicts the preferred embodiment for tensioning the sheet 10 around the rollers 12 and 15. In this preferred embodiment, the sheet 10 is secured to the movable side frame 21 by clamping bars 17. Sheet 10 is wrapped around the clamping bar 17 and is tightened to provide the desired tension on the deck sheet 10. As the clamping bar 17 is rotated, tension is developed in the deck, making it flat and rigid. As discussed previously, two clamping bars 17 are used and locked in place (after tensioning) to movable side frames 21, which move as the deck is adjusted.

In the preferred embodiment, the material for sheet 10 is a thin sheet of stainless steel shim stock of 0.005 inches thick. Alternatively, the sheet 10 may be comprised of any metal or synthetic material that provides sufficient stiffness to serve as a guide deck, while having the flexibility to be wrapped around the rollers 12 and 15 without being permanently deformed. This preferred material is also corrosion resistant, wear resistant, and has the ability to be tensioned and wrapped around small pulleys without permanent deforming.

Although the invention has been described with respect to preferred embodiments thereof, it will be understood by those skilled in the art that the foregoing and various other changes, omissions and deviations in the form and detail thereof may be made without departing from the spirit and scope of this invention.

What is claimed is:

1. A sheet accumulator for feeding and accumulating serially fed sheets in a paper path, the accumulator comprising:

an accumulator guide deck having an upper surface and forming a lower portion of the paper path and supporting sheets fed on the paper path;

a belt arrangement positioned above the accumulator deck and providing a driving force in a feed direction of the paper path for sheets on the deck, the belt arrangement and deck being biased in operative engagement with each other;

a ramp apparatus positioned across the paper path whereby sheets driven by the belt on an upstream portion of the accumulator deck are driven over the ramp apparatus and deposited in an accumulating region of the accumulator deck on a downstream side of the ramp apparatus; and an accumulator stop mechanism located at a downstream end of the accumulating region that prevents movement of sheets by the belt arrangement while sheets for an accumulation are being collected.

2. The sheet accumulator of claim 1 wherein the belt arrangement is arranged to interact with the ramp apparatus such that the belt arrangement acts to snap sheets down into the accumulating region after the sheets have passed over the ramp apparatus.

3. The sheet accumulator of claim 1 wherein the guide deck is comprised of an adjustable paper path guide deck apparatus, whereby a length of the accumulating region downstream of the ramp may be adjusted to accommodate different sized sheets.

4. The sheet accumulator of claim 3 wherein the adjustable paper path guide deck apparatus comprises:

a first roller proximal an input end;

a second roller proximal to an output end;

a flexible sheet of non-permanently deforming material wrapped around the first and second rollers, a surface of the sheet forming the guide deck comprising a portion of the paper path, the guide deck being movable along a paper path direction while rotating around the first and second rollers; and a locking mechanism coupled to the adjustable paper path guide deck apparatus for preventing the flexible sheet from moving around the first and second rollers when in a locked position, and allowing movement around the first and second rollers when in an unlocked position.

5. The sheet accumulator of claim 4 wherein the ramp apparatus is coupled to the flexible sheet, whereby a position of the ramp apparatus between the input end and the output end of the paper path is adjustable by moving the flexible sheet around the first and second rollers.

6. The sheet accumulator of claim 5 wherein the ramp apparatus is movable towards the output end for handling short sheets, and away from the output end for long sheets.

7. The sheet accumulator of claim 5 wherein the adjustable paper path guide deck apparatus further comprises a tensioner mechanism for tensioning the flexible sheet between the first and second rollers.

8. The sheet accumulator of claim 5 wherein the flexible sheet is comprised of a sheet having two ends and the ramp apparatus is coupled between the two ends, thereby making the ramp apparatus adjustably positionable between the first and second rollers.

9. The sheet accumulator of claim 8 wherein the adjustable paper path guide deck apparatus further comprises a tensioner mechanism for tensioning the flexible sheet between the first and second rollers.

10. The sheet accumulator of claim 9 wherein the tensioner mechanism is comprised of a coupling between an end of the flexible sheet and the ramp apparatus, the coupling comprising a clamping bar around which the flexible sheet is wrapped when the clamping bar is rotated.

11. The sheet accumulator of claim 5 further comprising a support frame supporting the first and second rollers, and wherein the ramp apparatus is movably coupled to and supported by the support frame.

12. The sheet accumulator of claim 11 wherein the locking mechanism comprises a sliding locking coupling between the ramp apparatus and the support frame.

13. The sheet accumulator of claim 12 wherein the support frame includes slotted side members through which a rod member of the sliding locking coupling is adjustably movable along the paper path direction to adjust a position of the ramp apparatus between the first and second rollers.

14. The sheet accumulator of claim 13 wherein the sliding locking coupling includes a screw locking mechanism to tighten the rod member to the support frame to prevent the ramp apparatus from moving when in the locked position.

15. The sheet accumulator of claim 4 wherein the adjustable paper path guide deck apparatus further comprises a tensioner mechanism for tensioning the flexible sheet between the first and second rollers.

16. The sheet accumulator of claim 15 wherein the tensioner mechanism is comprised of a clamping bar around which the flexible sheet is wrapped when the clamping bar is rotated.

17. The sheet accumulator of claim 15 wherein the tensioner mechanism is comprised of a mechanism for adjusting a distance between the first and second rollers around which the flexible sheet is wrapped.

18. The sheet accumulator of claim 4 wherein the flexible sheet is comprised of fully hardened stainless steel shim stock.

19. The sheet accumulator of claim 18 wherein the flexible sheet is 0.005 inches thick.

20. The sheet accumulator of claim 4 further comprising a third roller positioned between the first and second rollers, at least part of a circumference of the third roller intersecting with a plane of the guide deck between the first and second rollers, thereby causing the guide deck to have a sloped profile on either side of the third roller.

21. The sheet accumulator of claim 20 wherein the third roller is positioned proximal to the output end of the paper path.

22. The sheet accumulator of claim 1 further comprising a hold-down roller positioned immediately upstream of the ramp apparatus across the paper path, the hold down roller providing a downward biasing force on a lower run of the belt arrangement immediately before the ramp apparatus and providing a downward tension on belts of the belt arrangement as the belts move over the ramp apparatus.

23. The sheet accumulator of claim 1 wherein the belt arrangement is mounted on a movable frame assembly that can be moved to gain top access to the accumulator guide deck and ramp apparatus.

24. The sheet accumulator of claim 1 wherein the accumulator stop mechanism is a set of dump rollers across the paper path that form a motionless nip to stop sheets while the accumulation is being formed, and that drive the accumulation from the accumulation region after the accumulation is complete.

25. The sheet accumulator of claim 24 wherein a top roller of the set of rollers is comprised of a material capable of absorbing impacts of sheets being stopped by the dump rollers, and a bottom roller of the set of rollers is comprised of a material harder than the top roller for supporting the accumulation formed at the dump rollers.

* * * * *